US007494693B2

(12) United States Patent
Yamaoka et al.

(10) Patent No.: US 7,494,693 B2
(45) Date of Patent: Feb. 24, 2009

(54) CERAMIC THIN FILM COATING MATERIAL HAVING SLOPE CONSTITUTION AND PROCESS FOR THE PRODUCTION THEREOF

(75) Inventors: Hiroyuki Yamaoka, Ube (JP); Yoshikatsu Harada, Ube (JP); Teruaki Fujii, Ube (JP); Shinichirou Otani, Ube (JP)

(73) Assignee: Ube Industries, Ltd., Yamaguchi-Ken (JP)

( * ) Notice: Subject to any disclaimer, the term of this patent is extended or adjusted under 35 U.S.C. 154(b) by 0 days.

(21) Appl. No.: 11/584,637

(22) Filed: Oct. 23, 2006

(65) Prior Publication Data

US 2007/0059560 A1 Mar. 15, 2007

Related U.S. Application Data

(62) Division of application No. 10/522,775, filed as application No. PCT/JP03/09981 on Aug. 6, 2003, now abandoned.

(30) Foreign Application Priority Data

Aug. 9, 2002 (JP) ..... 2002-232685

(51) Int. Cl.

| | |
|---|---|
| ***B05D 3/02*** | (2006.01) |
| ***B05D 3/04*** | (2006.01) |
| ***B05D 1/36*** | (2006.01) |
| ***B05D 7/00*** | (2006.01) |
| ***C08K 3/22*** | (2006.01) |
| ***C04B 35/00*** | (2006.01) |
| ***B01J 21/00*** | (2006.01) |

(52) U.S. Cl. ..... 427/376.3; 427/376.2; 427/377; 427/380; 427/397.7; 427/407.2; 427/419.1; 501/96.2; 501/97.1; 501/154; 502/236; 524/497

(58) Field of Classification Search ..... 428/701; 427/314, 331, 372.2, 376.2, 397.7, 397.8, 427/226

See application file for complete search history.

(56) References Cited

U.S. PATENT DOCUMENTS 5,939,194 A * 8/1999 Hashimoto et al. ..... 428/411.1

(Continued)

FOREIGN PATENT DOCUMENTS

JP 56-074126 6/1981

(Continued)

OTHER PUBLICATIONS

Howitt et al. The oriented growth of anatase in thin films of amorphous titania. J. Mater. Res. 2(2), Mar./Apr. 1987, pp. 201-210.*

*Primary Examiner*—Carol Chaney
*Assistant Examiner*—Nicole T Gugliotta
(74) *Attorney, Agent, or Firm*—Wenderoth, Lind & Ponack, L.L.P.

(57) ABSTRACT

The present invention is characterized in that a base material is coated with a ceramic thin film comprising a composite phase composed of a first phase mainly formed of a silicon ceramic component and a second phase mainly formed of a ceramic component other than the silicon ceramic component of the first phase, in which the amount of fine crystal particles of at least one ceramic component that constitutes the second phase slopingly increases toward a surface layer. According to the present invention, there are provided a ceramic thin film coating material having a slope constitution, which not only has an excellent function such as a photocatalyst function, an electrical function, a thermal catalyst function or a catalyst-supporting function or environment resistance such as oxidation resistance, alkaline resistance or wear resistance but also has excellent dynamic properties, and a process for the production thereof.

12 Claims, 2 Drawing Sheets

U.S. PATENT DOCUMENTS

| | | | | |
|---|---|---|---|---|
| 5,939,201 | A | 8/1999 | Boire et al. | |
| 6,013,372 | A | 1/2000 | Hayakawa et al. | |
| 6,362,121 | B1 | 3/2002 | Chopin et al. | |
| 6,403,689 | B1 | 6/2002 | Lehaut et al. | |
| 6,541,416 | B2 * | 4/2003 | Ishikawa et al. | 502/240 |
| 2002/0001702 | A1 * | 1/2002 | Ishikawa et al. | 428/292.1 |
| 2005/0129927 | A1 | 6/2005 | Minami et al. | |

FOREIGN PATENT DOCUMENTS

| | | | |
|---|---|---|---|
| JP | 4-187583 | | 7/1992 |
| JP | 7-312459 | A | 11/1995 |
| JP | 2000-289528 | | 4/2002 |

* cited by examiner

Ultraviolet Radiation (352nm, 2mW/cm$^2$)

CERAMIC THIN FILM COATING MATERIAL HAVING SLOPE CONSTITUTION AND PROCESS FOR THE PRODUCTION THEREOF

This is a divisional of Ser. No. 10/522,775, filed Jan. 31, 2005, now abandoned, which is a 371 of PCT/JP03/09981, filed Aug. 6, 2003.

TECHNICAL FIELD

The present invention relates to a ceramic thin film coating material having a slope constitution, which not only has an excellent function such as a photocatalyst function, an electrical function, a thermal catalyst function, a catalyst-supporting function, etc., or environment resistance such as oxidation resistance, alkaline resistance, wear resistance, etc., but also has excellent dynamic properties and a process for the production thereof. Specifically, it relates to a ceramic thin film coating material excellent in adhesion to a base material and free from cracks and defects, which coating material comprises a first phase exercising dynamic properties and a second phase exercising a variety of functions and existing in a surface layer and a layer near to the surface layer and has a slope constitution toward the surface layer, and to a process for the production thereof.

TECHNICAL BACKGROUND

Conventionally, a variety of proposals have been advanced on ceramic materials having a function such as a photocatalyst function, an electrical function, a thermal catalyst function or a catalyst-supporting function or environment resistance such as oxidation resistance, alkaline resistance or wear resistance.

For example, with regard to the photocatalyst function of a semiconductor typified by titanium dioxide, it is carried out to form a titania film on the surface of a base material. As a method for forming the titania film on the surface of the base material, there are a sol-gel process and a binder process.

The sol-gel process is a method in which a sol of an organic titanium, which is a precursor for titania, such as titanium alkoxide or titanium chelate is applied to the surface of a heat-resistant base material such as a glass or a ceramic with a spray or the like, the applied sol is dried to form a gel, and the resultant base material with the gel is heated up to 500° C. or more, thereby forming a strong titania film. Titania particles are present on the entire surface of the base material so that the formed titania film can have a high decomposing power and high hardness.

The binder process is a method in which titania particles are fixed on the surface of a base material with a binder. The binder process uses inorganic binders such as silica or organic binders such as silicon.

In the sol-gel process, heat treatment is carried out for converting an organic titanium, which is a precursor for titania, such as titanium alkoxide or titanium chelate into a titania film. Since the crystal form of titania converts from anatase into rutile at a high temperature, the heat treatment is carried out at 500-700° C. at most. For this reason, there is a problem in that the adhesion between the titania film and the base material is insufficient.

In the sol-gel process, in addition, the number of times the aforesaid organic titanium is applied is large and it requires much labor and time. Further, the sol-gel process requires expensive facilities and the cost required is therefore high. Moreover, harmful wastes are generated.

In the binder process, it is necessary to use, as a binder, a material which has high adhesion to a base material and is not affected by the decomposing function of a photocatalyst, so that a problem is that the selection of binder affects the effect.

Further, the binder process has a problem in that the hardness of the titania film formed is low. It is possible to improve the hardness of the titania film formed according to the binder process by increasing the amount of the binder so as to increase the adhesive power. In this case, the amount of titania becomes relatively small when compared with the amount of the binder and therefore the decomposing power descends. In contrast, when the amount of the binder is decreased, the amount of titania exposed on the surface of a base material increases and therefore the decomposing power increases. However, in this case, the adhesive power decreases so that the titania film is apt to be peeled off and the hardness decreases.

On the other hand, concerning a fiber-reinforced ceramic-based composite material or a particle-dispersed type ceramic material, it has been carried out to coat the surface thereof with a ceramic material such as zirconia in order to impart environment resistance such as oxidation resistance, alkaline resistance or wear resistance.

However, for example, when a base material of SiC is coated with zirconia by the sol-gel process, the adhesion between the base material and the zirconia film is not sufficient and, in addition, a crack or a defect easily occurs.

It is an object of the present invention to overcome the above problems and provide a ceramic thin film coating material having a slope constitution which material is excellent in the adhesion to a base material and free from cracks and defects and not only has excellent functions such as a photocatalyst function, an electrical function, a thermal catalyst function, a catalyst-supporting function, etc., or environment resistance such as oxidation resistance, alkaline resistance, wear resistance, etc., but also has excellent dynamic properties, and a process for the production thereof.

DISCLOSURE OF THE INVENTION

The present invention relates to a ceramic thin film coating material having a slope constitution, which comprises a base material and a ceramic thin film comprising a composite phase composed of a first phase mainly formed of a silicon ceramic component and a second phase mainly formed of a ceramic component other than the silicon ceramic component of the first phase, in which the amount of fine crystal particles of at least one ceramic component that constitutes the second phase slopingly increases toward a surface layer, the base material being coated with the ceramic thin film.

Further, the present invention relates to a process for the production of the above ceramic thin film coating material having a slop structure, which process comprises coating a base material surface with a modified organosilicon polymer having a structure obtained by modifying an organosilicon polymer with an organometallic compound or a mixture of an organosilicon polymer or said modified organosilicon polymer with an organometallic compound, carrying out a predetermined heat treatment, and calcining the resultant base material in an oxidizing atmosphere, an inert atmosphere or a nitrogen-containing atmosphere.

MOST PREFERABLE EMBODIMENT FOR CARRYING OUT THE INVENTION

Figure 1:
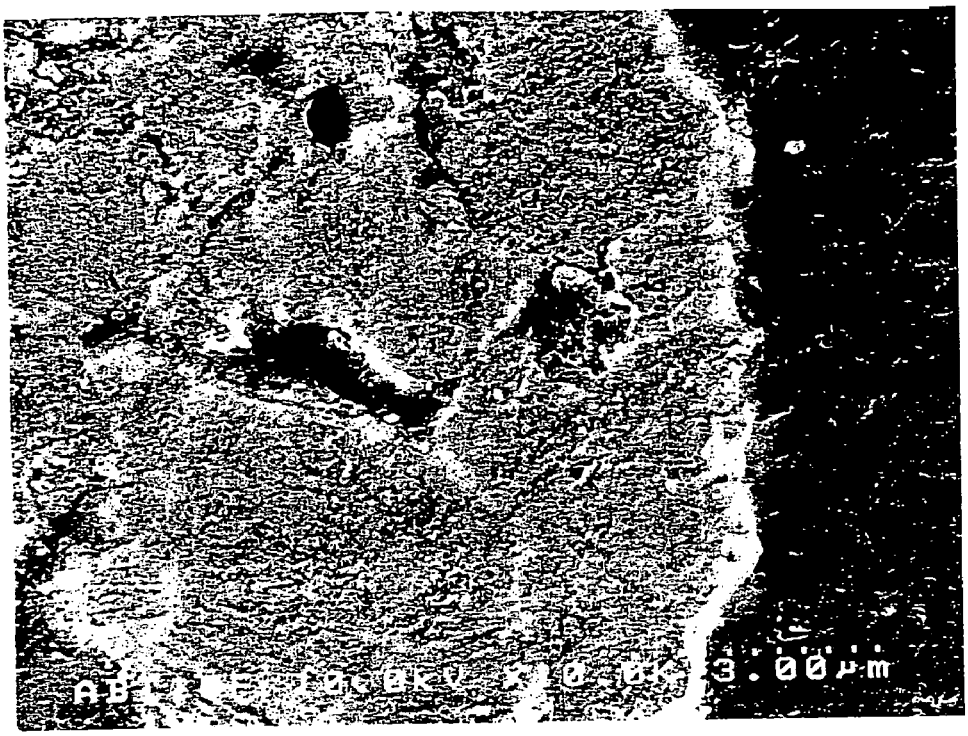
FIG. 1 is a scanning electron micrograph showing a portion near the surface in a cross section of an alumina ball obtained in Example 1 of the present invention.
Figure 2:
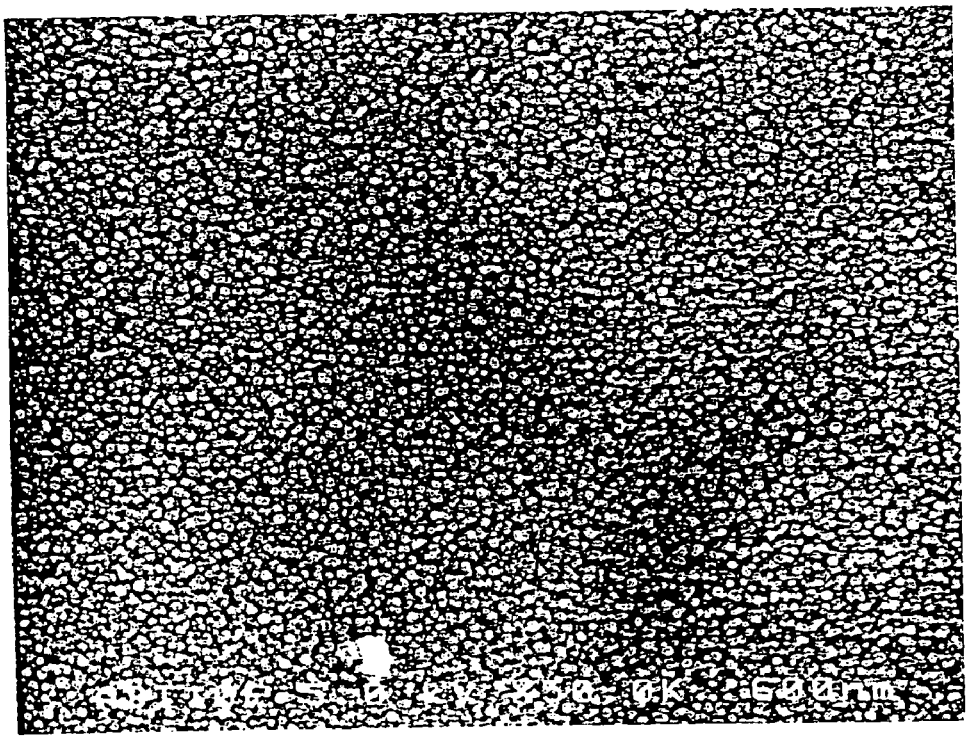
FIG. 2 is a scanning electron micrograph showing the structure of the outermost surface of an alumina ball obtained in Example 1 of the present invention.
Figure 3:
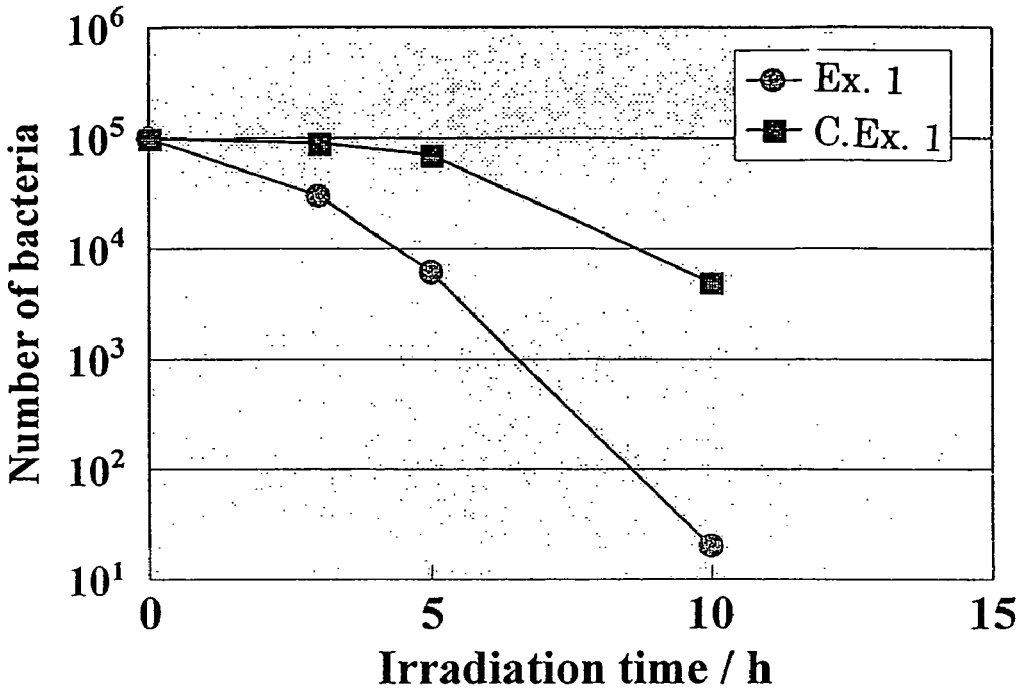
FIG. 3 is a figure showing the catalytic activity test results of an alumina ball obtained in Example 1 of the present invention.

The present inventors have found the following. By coating the surface of a base material with a modified organosilicon polymer having a structure obtained by modifying an organosilicon polymer with an organometallic compound or a mixture of an organosilicon polymer or said modified organosilicon polymer with an organometallic compound and carrying out a predetermined heat treatment, the above organometallic compound or a low-molecular weight substance containing the above organometallic compound component selectively moves (bleed out) to the surface. Then, the resultant base material is calcined in a predetermined atmosphere, thereby effectively generating a ceramic thin film having a surface layer (layer having an intended function or environment resistance) derived from the above organometallic compound component. The ceramic thin film is free from cracks or defects and excellent in the adhesion to the base material.

In the present invention, the first phase mainly formed of a silicon ceramic component may be amorphous or crystalline. The silicon ceramic component can be at least one member selected from $SiO_2$, SiC and $Si_3N_4$.

For example, when the silicon ceramic component of the first phase is $SiO_2$ (silica), the first phase may contain a metal element or a metal oxide which can form a solid solution or a eutectic compound with silica. Although a metal element (A) which can form a solid solution with silica and a metal element (B) whose oxide can form a compound having a specific constitution with silica are not specially limited, example of the metal element (A) include titanium and examples of the metal element (B) include aluminum, zirconium, yttrium, lithium, sodium, barium, calcium, boron, zinc, nickel, manganese, magnesium and iron.

The first phase forms an inside phase of the ceramic thin film obtained in the present invention and it plays an important role in exercising dynamic properties. The amount of the first phase based on the ceramic thin film as a whole is preferably 99 to 40% by weight. It is preferred to control the amount of the first phase in the range of from 50 to 95% by weight for exerting an intended function of the second phase sufficiently and exerting high dynamic properties concurrently.

On the other hand, the ceramic component that constitutes the second phase plays an important role in exerting an intended function in the present invention and is selected depending upon the intended function. The ceramic component that constitutes the second phase can be at least one member selected from oxides, nitrides and carbides. For example, it includes $TiO_2$, $ZrO_2$, BN, $Al_2O_3$, TiN, TiC, etc. For example, when a photocatalyst function or a thermal-catalyst function is required, $TiO_2$, its eutectic compound or its substitutional solid solution with a specific element is selected. When alkaline resistance, oxidation resistance, a catalyst function or a catalyst-supporting function is required, $ZrO_2$ is selected. Further, $Al_2O_3$ can impart oxidation resistance and TiN or TiC can impart a function such as wear resistance. When piezoelectric properties are desired, a lead/zirconium/titanium type oxide, etc., is selected.

In particular, when the ceramic component that constitutes the second phase is titania, its crystal form generally converts from an anatase form to a rutile form by heating to 700° C. or more. In the present invention, even when the calcining for forming the thin film is carried out at a high temperature of 1,300° C., the crystal is still in the anatase form. Therefore, the adhesion to the base material can be strengthened by calcining at a high temperature.

The particle diameter of fine crystals of the ceramic component that constitutes the second phase is generally 50 nm or less. When a photocatalyst function or a thermal catalyst function is required, the particle diameter is preferably 15 nm or less, particularly preferably 10 nm or less.

Although the amount of the second phase that constitutes a surface layer part of the ceramic thin film of the present invention differs depending upon its kind, it is preferably 1 to 60% by weight. It is preferred to control the amount of the second phase in the range of 5 to 50% by weight for fully exerting its function and concurrently exerting high strength.

The amount of fine crystal particles of at least one ceramic component that constitutes the second phase slopingly increases towards the surface. It is preferred that the thickness of a region where the slope in the constitution is apparently recognized is controlled in the range of 5 to 500 nm. In the present invention, the "amount" of the first phase and the "amount" of the second phase refer to "% by weight" of the silicon ceramic component of the first phase and "% by weight" of the ceramic component of the second phase, respectively, based on the total of the silicon ceramic component that constitutes the first phase and the ceramic component that constitutes the second phase, i.e., based on the entire ceramic thin film.

The base material used in the present invention is not specially limited in substance and may be a glass, a ceramic, a metal, etc., so long as it is able to endure calcining at a high temperature. It is preferably a glass or a ceramic which is excellent in heat resistance.

In addition, the shape of the base material is not specially limited and may be a plate shape, a cylindrical shape, a prismatic shape, a conical shape, a spherical shape, a gourd shape, a rugby ball shape, etc. Further, the base material may be in a closed shape, may have a lid, maybe in a hollow, spherical shape such as a circular tube shape, a rectangular tube shape, a fiber shape or microballoon, and may be honeycomb or porous.

Then, the process for the production of the ceramic thin film coating material having a slope constitution, provided by the present invention, will be explained.

In the present invention, the ceramic thin film coating material having a slope constitution can be produced by coating the surface of a base material with a modified organosilicon polymer having a structure obtained by modifying an organosilicon polymer with an organometallic compound or a mixture of an organosilicon polymer or said modified organosilicon polymer with an organometallic compound, carrying out a predetermined heat treatment and then calcining the resultant base material in an oxidizing atmosphere, an inert atmosphere or a nitrogen-containing atmosphere.

The organosilicon polymer is not specially limited. The organosilicon polymer includes polycarbosilane, polysilazane, polysilastyrene, methylchloropolysilane, etc. The organosilicon polymer preferably has a number average molecular weight in the range of from 200 to 10,000.

As the organometallic compound, there is used a compound having a basic structure represented by the formula M(OR')n (wherein M is a metal element, R' is analkyl group having 1 to 20 carbon atoms or a phenyl group and n is an integer of more than 1) or the formula MR"m (wherein M is a metal element, R" is acetylacetonate and m is an integer of more than 1).

Further, the modified organosilicon polymer can be obtained by modifying the aforesaid organosilicon polymer with the aforesaid organometallic compound. The modified organosilicon polymer preferably has a number average molecular weight in the range of from 1,000 to 50,000.

In the present invention, it is necessary to carefully control the modification state of the aforesaid organosilicon polymer with the aforesaid organometallic compound.

A case of a modified polycarbosilane will be explained below.

The fundamental production process of the modified polycarbosilane is extremely similar to JP-A-56-74126.

The modified polycarbosilane is mainly derived from a polycarbosilane having a main chain skeleton represented by the formula,

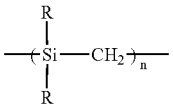

(in which R is a hydrogen atom, a lower alkyl group or a phenyl group) and a number average molecular weight of 200 to 10,000 and an organometallic compound having a basic structure of the formula M(OR')n or the formula MR"m (in which M is ametal element, R' is an alkyl group having 1 to 20 carbon atoms or a phenyl group, R" is acetylacetonate, and each of m and n is an integer of more than 1).

For producing the ceramic thin film having a slope constitution, provided by the present invention, it is required to select slow reaction conditions where the above organometallic compound forms a monofunctional polymer with the polycarbosilane and only part of the above organometallic compound forms a bond with the polycarbosilane. For the above purpose, it is required to carry out the reaction at a temperature of 280° C. or lower, preferably 250° C. or lower, in an inert gas. Under the above reaction conditions, even when the above organometallic compound is reacted with the polycarbosilane, it bonds as a monofunctional polymer (i.e., a pendant-like bonding) and no large increase in molecular weight occurs. The thus-obtained modified polycarbosilane in which the organometallic compound is partially bonded plays an important role in improving the compatibility between the polycarbosilane and the organometallic compound.

When two or more functional groups are bonded, the polycarbosilane forms a cross-linking structure and a noticeable increase in molecular weight is observed. In this case, sudden heat generation and an increase in melt viscosity occur in the reaction. On the other hand, when the above-mentioned monofunctional polymer is formed and an unreacted organometallic compound remains, conversely, a decrease in melt viscosity is observed.

In the present invention, it is preferred to select conditions where an unreacted organometallic compound is intentionally left. The present invention uses mainly, as a starting material, a material in which the above modified polycarbosilane coexists with an organometallic compound which is in an unreacted state or an organometallic compound which is dimer, trimer or so. However, the modified polycarbosilane alone can be similarly used as a starting material when the modified polycarbosilane contains a modified polycarbosilane component having an extremely low molecular weight. Further, a mixture of the polycarbosilane and the organometallic compound may be also used.

Then, the aforesaid modified organosilicon polymer having a structure obtained by modifying organosilicon polymer with organometallic compound or a mixture of the organosilicon polymer or the above modified silicon polymer with the organometallic compound (to be referred to as "precursor polymer" hereinafter) is dissolved in an organic solvent such as toluene or xylene to prepare a solution and the solution is used to coat the surface of a base material.

The coating method is selected from known coating methods such as a dip-coating method, a spin-coating method, an application method and a spray method.

In this case, the thickness of the ceramic thin film to be obtained can be adjusted in the range of from several tens nm to several μm by changing the concentration of the precursor polymer or the number of times the solution of the precursor polymer is applied.

Then, the base material coated with the precursor polymer is subjected to a predetermined heat treatment. The heat treatment is carried out in the same atmosphere as the calcining atmosphere to be described later at a temperature of generally from 50 to 400° C. for from several hours to 30 hours. In the heat treatment, the bleeding-out of the second phase component in the precursor polymer to the surface advances and the ground of the intended slope constitution is accordingly formed.

Then, the base material after the above heat treatment is calcined at a temperature in the range of from 500 to 1,800° C. in an oxidizing atmosphere, an inert atmosphere or a nitrogen-containing atmosphere, thereby forming on the base material an intended ceramic thin film comprising a composite phase composed of a first phase mainly formed of a silicon ceramic component and a second phase mainly formed of a ceramic component other than the silicon ceramic component of the first phase, in which the amount of fine crystal particles of at least one ceramic component that constitutes the second phase slopingly increases toward a surface layer.

The first phase mainly formed of a silicon ceramic component, formed by the calcining, varies depending upon the kind of the precursor polymer or the above calcining atmosphere. For example, $SiO_2$ mainly generates in the oxidizing atmosphere, SiC mainly generates in the inert atmosphere such as nitrogen, argon or vacuum, and $Si_3N_4$ mainly generates in ammonia atmosphere. Further, when the precursor polymer is polysilazane, $Si_3N_4$ mainly generates even in the inert atmosphere.

EXAMPLES

The present invention will be explained with reference to Examples hereinafter.

Referential Example 1

2.5 liters of anhydrous toluene and 400 g of metallic sodium were placed in a three-necked flask having a volume of 5 liters, the mixture was heated to the boiling point of toluene under a flow of nitrogen gas, and 1 liter of dimethyldichlorosilane was dropwise added over 1 hour. After the completion of the addition, the mixture was refluxed under heat for 10 hours to obtain a precipitate. The precipitate was recovered by filtration, and washed with methanol and then with water to give 420 g of a white powder polydimethylsilane.

250 g of the polydimethylsilane was placed in a three-necked flask equipped with a water-cooling refluxing device, and allowed to react under heat at 420° C. for 30 hours under a flow of nitrogen gas, to obtain a polycarbosilane having a number average molecular weight of 1,200.

Example 1

100 g of toluene and 64 g of tetrabutoxytitanium were added to 16 g of polycarbosilane synthesized according to Referential Example 1, the mixture was preliminarily heated at 100° C. for 1 hour, then, the mixture was slowly temperature-increased up to 150° C. to distill the toluene off, the resultant mixture was allowed to react at the above temperature for 5 hours, and then the reaction mixture was further temperature-increased up to 250° C. and allowed to react at this temperature for 5 hours, to obtain a modified polycarbosilane. 10 g of tetrabutoxytitanium was added to the modified polycarbosilane for the purpose of intentionally making a low-molecular weight organometallic compound coexist, to obtain a mixture of the modified polycarbosilane and the low-molecular weight organometallic compound.

The above mixture of the modified polycarbosilane and the low-molecular weight organometallic compound was dissolved in toluene to prepare a 10% by weight toluene solution. Then, 100 g of the above toluene solution was placed in a stainless-steel container containing 100 g of alumina balls having a diameter of 2 mm and the solution was impregnated into the alumina balls under vacuum. The alumina balls were taken out after the impregnation. The alumina balls were allowed to stand in atmospheric air at room temperature to dry them. Then, the alumina balls were stepwise heated up to 150° C. in air to infusibilize them. Then, the infusibilized alumina balls were calcined in air at 1,200° C. for 1 hour, thereby obtaining ceramic thin film coating alumina balls. As a result of electron microscopic observation, a coating layer having a thickness of about 0.5 μm was formed on the surface of each alumina ball. The alumina balls had a structure in which the surface is coated with fine titania having a particle diameter of about 10 nm. The adhesion of the alumina ball and the coating layer was very excellent and no peeling off of the coating layer was found. In addition, the coating layer was examined for the distribution state of constitutive atoms by EPMA (electro probe microanalysis). The molar ratio of Ti/Si was 0.80 in a region of from the outermost surface to a depth of 0.1 μm, the molar ratio of Ti/Si was 0.20 in a region of from a depth of 0.2 μm to a depth of 0.3 μm below the outermost surface, and the molar ratio of Ti/Si was 0.10 in a region of a depth of 0.4 μm or deeper below the outermost surface. Accordingly, it was confirmed that the ceramic thin film coating alumina ball had a slope constitution in which titania increased towards the surface.

1 g of the above alumina balls and water containing 100,000 cells of *Escherichia coli* per 1 ml were placed in a Schale and exposed to ultraviolet light having a wavelength of 352 nm for 10 hours. After the exposure, the above water was taken and it was subjected to cultivation in an agar medium, to measure the number of living cells of *Escherichia coli*. As a result thereof, the number of cells of *Escherichia coli* was decreased to 20 or less (minimum limit of detection or lower) because of the 10-hour exposure. It was confirmed that the ceramic thin film coating alumina balls had an excellent photocatalyst function.

Comparative Example 1

120 g of titanium tetraisopropoxide was diluted with 1,000 ml of isopropanol, 40 g of diisopropanolamine and 10 g of water were added with stirring, and 10 g of polyethylene glycol having a molecular weight of 1,000 was added, to prepare a transparent titania sol liquid.

100 g of the above titania sol liquid was poured in a stainless steel container containing 100 g of alumina balls having a diameter of 2 mm, and impregnation was carried out under vacuum. The alumina balls were taken out after the impregnation. The alumina balls were allowed to stand in atmospheric air at room temperature to dry them. Then, the alumina balls were calcined in air at 600° C. for 1 hour, thereby obtaining ceramic thin film coating alumina balls. As a result of electron microscopic observation, it was confirmed that a coating layer having a thickness of about 0.5 μm was formed on the surface of each alumina ball. However, the adhesion between the coating layer and the alumina ball was insufficient. The coating layer was peeled off when touched with a finger.

1 g of the above alumina balls and water containing 100,000 cells of *Escherichia coli* per 1 ml were placed in a Schale and exposed to ultraviolet light having a wavelength of 352 nm for 10 hours. After the exposure, the above water was taken and it was subjected to cultivation in an agar medium, to measure the number of living cells of *Escherichia coli*. As a result thereof, the number of cells of *Escherichia coli* was decreased to 5,000 because of the 10-hour exposure so that a photocatalyst function was found. However, its activity was low. Further, it was found that titania of the coating layer peeled off from the alumina balls precipitated in the water.

Example 2

100 g of toluene and 64 g of tetrabutoxyzirconium were added to 16 g of polycarbosilane synthesized according to Referential Example 1, the mixture was preliminarily heated at 100° C. for 1 hour, then, the mixture was slowly temperature-increased up to 150° C. to distill the toluene off, the resultant mixture was allowed to react at the above temperature for 5 hours, and then the reaction mixture was further temperature-increased up to 250° C. and allowed to react at this temperature for 5 hours, to synthesize a modified polycarbosilane. 5 g of tetrabutoxyzirconium was added to the modified polycarbosilane for the purpose of intentionally making a low-molecular weight organometallic compound coexist, to obtain a mixture of the modified polycarbosilane and the low-molecular weight organometallic compound.

The above mixture of the modified polycarbosilane and the low-molecular weight organometallic compound was dissolved in toluene. Then, the resultant solution was applied to one surface of a flat plate made of silicon carbide with a spray gun. The flat plate was stepwise heated up to 150° C. in air to infusibilize it. Then, the infusibilized flat plate was calcined in an argon gas at 1,400° C. for 1 hour. As a result of electron microscopic observation, a coating layer having a thickness of about 10 μm was formed on the surface of the flat plate made of silicon carbide. As a result of TEM observation, the coating layer is composed of zirconia and silicon carbide. Further, the coating layer was examined for the distribution state of constitutive atoms by EPMA. The molar ratio of Zr/Si was 0.80 in a region of from the outermost surface to a depth of 1 μm, the molar ratio of Zr/Si was 0.25 in a region of from a depth of 3 μm to a depth 4 μm below the outermost surface, and the molar ratio of Zr/Si was 0.10 in a region of a depth of 5 μm or deeper below the outermost surface. Accordingly, it was confirmed that the flat plate had a slope constitution in which zirconium increased towards the surface.

The flat plate made of silicon carbide was heat-treated in air at 1,400° C. for 1 hour and then cooled down to room temperature. Then, it was observed through an electron microscope. As a result thereof, no failure such as a crack was found in the coating layer and no oxidation was found in the inside silicon carbide. That is, it was confirmed that the coating layer had a sufficient function as an oxidation-resistant coating for silicon carbide.

Comparative Example 2

A zirconia sol was prepared from zirconium tetrapropoxide as a main raw material according to the method described in New Ceramics No. 8, pp. 53-58 (1996). The zirconia sol was applied to a flat plate made of silicon carbide in the same manner as in Example 1. The resultant flat plate was calcined in air at 1,000° C. for 1 hour. As a result of electron microscopic observation, a coating layer having a thickness of about 10 μm was formed on the surface of the flat plate made of silicon carbide. As a result of TEM observation, the coating layer is formed of zirconia.

The thus-obtained flat plate made of silicon carbide was heat-treated in air at 1,400° C. for 1 hour and then cooled down to room temperature. Then, it was observed through an electron microscope. As a result thereof, a lot of cracks were found in the coating layer and peeling-off of the coating layer was found. In addition, oxidation was found in the inside silicon carbide. That is, it was confirmed that the coating layer had no function as an oxidation-resistant coating for silicon carbide.

INDUSTRIAL UTILITIES

According to the present invention, there is obtained a ceramic thin film coating material having a slope constitution, which is excellent in adhesion to a base material and free from cracks or defects and has not only excellent functions such as a photocatalyst function, a thermal catalyst function, a catalyst-supporting function, etc., or environment resistance such as oxidation resistance, alkaline resistance, wear resistance, etc., but also excellent dynamic properties.

For example, when the ceramic component that constitutes the second phase is titania, generally, the crystal form of titania converts from anatase into rutile by heating up to 700° C. or higher. In the present invention, even when the calcining for forming the thin film is carried out at a high temperature of 1,300° C., the crystal form of titania is still anatase. Therefore, the adhesion to the base material can be strengthened by calcining at a high temperature.

Further, when the base material is SiC, the adhesion to the base material can be strengthened by using SiC as the first phase.

The invention claimed is:

1. A process for producing ceramic thin film coating material having a slope constitution, which comprises a base material and a ceramic thin film comprising a composite phase composed of a first phase mainly formed of a silicon ceramic component and a second phase mainly formed of a ceramic component other than the silicon ceramic component of the first phase, in which the amount of fine crystal particles of at least one ceramic component that constitutes the second phase slopingly increases toward a surface layer, the base material being coated with the ceramic thin film, which process comprises coating a base material with a) a modified organosilicon polymer having a structure obtained by modifying an organosilicon polymer with an organometallic compound, b) a mixture of an organosilicon polymer with an organometallic compound, or c) a mixture of said modified organosilicon polymer with an organometallic compound, carrying out a predetermined heat treatment, and calcining the resultant base material at a temperature in the range of from 1200 to 1,800° C. in an oxidizing atmosphere, an inert atmosphere or a nitrogen-containing atmosphere.

2. The process for producing a ceramic thin film coating material according to claim 1, wherein the amount of the first phase is from 99 to 40% by weight and the amount of the second phase is 1 to 60% by weight.

3. The process for producing a ceramic thin film coating material according to claim 1, wherein the amount of the fine crystal particles of the at least one ceramic component that constitutes the second phase slopingly increases from a depth of from 5 to 500 nm to the surface of the ceramic thin film.

4. The process for producing a ceramic thin film coating material according to claim 1, wherein the fine crystal particles of the at least one ceramic component that constitutes the second phase have a particle diameter of 50 nm or less.

5. The process for producing a ceramic thin film coating material according to claim 1, wherein the ceramic component that constitutes the second phase is at least one member selected from the group consisting of oxides, nitrides and carbides.

6. The process for producing a ceramic thin film coating material according to claim 1, wherein the ceramic component that constitutes the second phase is at least one member selected from the group consisting of $TiO_2$, $ZrO_2$, $Al_2O_3$, TiN and TiC.

7. The process for producing a ceramic thin film coating material according to claim 6, wherein the ceramic component that constitutes the second phase is titania and its crystal particle diameter is 15 nm or less.

8. The process for producing a ceramic thin film coating material according to claim 7, wherein the crystal form of titania is anatase.

9. The process for producing a ceramic thin film coating material according to claim 1, wherein the silicon ceramic component is at least one member selected from the group consisting of $SiO_2$, SiC and $Si_3N_4$.

10. The process for producing a ceramic thin film coating material according to claim 1, wherein the ceramic thin film has a photocatalyst function and/or a thermal catalyst function.

11. The process for producing a ceramic thin film coating material according to claim 1, wherein the base material is a glass or a ceramic.

12. The process according to claim 1, wherein the organometallic compound is a compound having a basic structure of the formula M(OR')n, wherein M is a metal element, R' is an alkyl group having 1 to 20 carbon atoms or a phenyl group and n is an integer of more than 1, or the formula MR"m, wherein M is a metal element, R" is acetylacetonate and m is an integer of more than 1.

* * * * *